United States Patent [19]

Cardona et al.

[11] Patent Number: 4,525,087

[45] Date of Patent: Jun. 25, 1985

[54] PAPER HANDLING APPARATUS WITH CONTINUOUS DRIVE ROLL AND PRESSURE FINGER

[75] Inventors: Ramon M. Cardona, Des Plaines; Theodore M. Leno, Arlington Heights; Melody M. O'Leary, Evanston, all of Ill.

[73] Assignee: AT&T Teletype Corporation, Skokie, Ill.

[21] Appl. No.: 586,387

[22] Filed: Mar. 5, 1984

[51] Int. Cl.[3] ..... B41J 11/26

[52] U.S. Cl. ..... 400/613.2; 400/645.4

[58] Field of Search ..... 400/613.2, 634, 641, 400/645, 645.3, 645.4, 645.5; 226/188–190, 192, 194

[56] References Cited

U.S. PATENT DOCUMENTS

| | | | |
|---|---|---|---|
| 1,024,759 | 4/1912 | Woodward | 400/645.4 X |
| 1,025,213 | 5/1912 | Smith | 400/645.4 X |
| 1,189,611 | 7/1916 | Morse | 226/192 |
| 2,356,842 | 8/1944 | Helmond | 400/641 |
| 2,973,081 | 2/1961 | Maidment et al. | 400/613.2 |
| 4,155,662 | 5/1979 | Maroth | 400/641 |
| 4,175,687 | 11/1979 | Kenworthy | 226/188 |
| 4,192,497 | 3/1980 | Perun et al. | 271/121 |

FOREIGN PATENT DOCUMENTS

| | | | |
|---|---|---|---|
| 842410 | 6/1952 | Fed. Rep. of Germany | 226/194 |
| 2707657 | 8/1978 | Fed. Rep. of Germany | 226/190 |

*Primary Examiner*—E. H. Eickholt
*Attorney, Agent, or Firm*—A. A. Tirva

[57] ABSTRACT

Apparatus for handling fanfold paper exiting from a printer includes a pair of drive rollers which support the paper and with a pair of pressure fingers which press the paper against the drive rollers to exert a nearly constant pulling force on the paper. The pressure fingers are periodically lifted from the paper to permit straight paper flow.

5 Claims, 4 Drawing Figures

FIG. 1
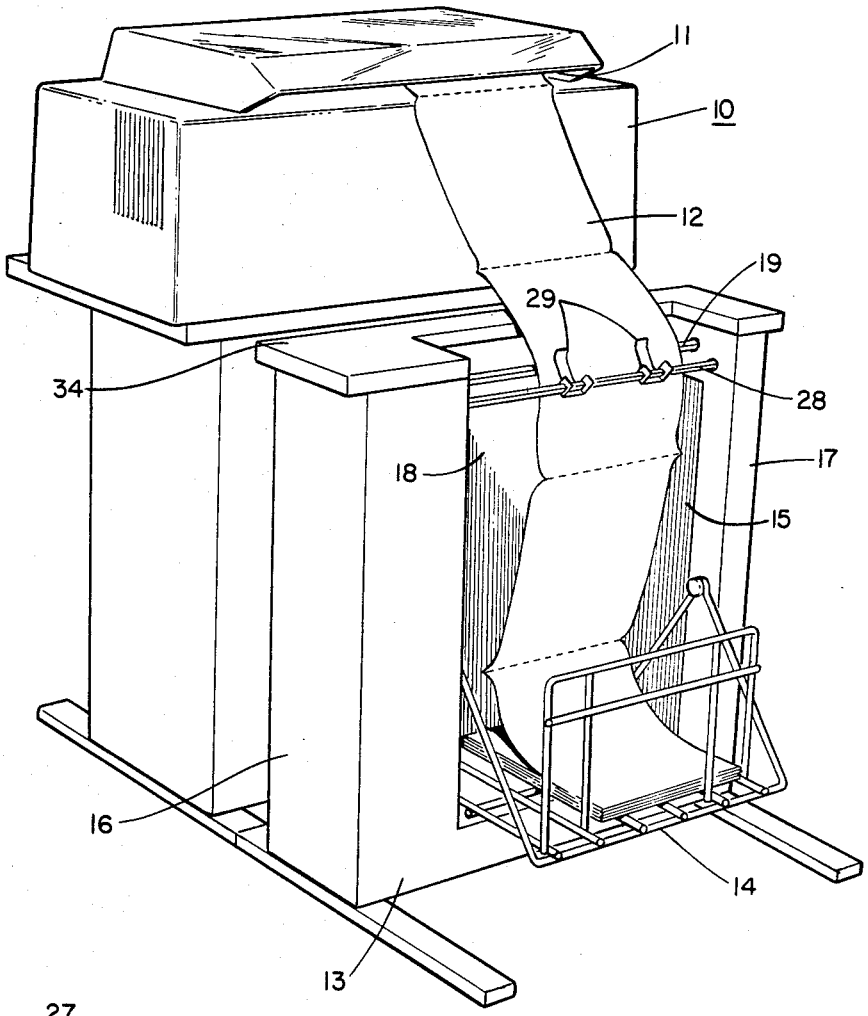
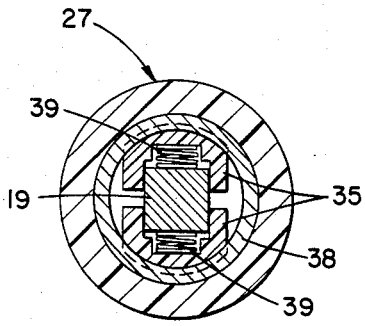
FIG. 4

PAPER HANDLING APPARATUS WITH CONTINUOUS DRIVE ROLL AND PRESSURE FINGER

TECHNICAL FIELD

This invention relates to printers utilizing continuous form paper as a recording medium and more particularly to an apparatus for handling such type of paper as it exits a printer.

BACKGROUND ART

Continuous form paper, which is also known as fan-fold paper, as a rule consists of a continuous web of paper having a plurality of forms or sheets of paper wherein the forms are joined by perforated sections which are folded one on top of another in a stack. The continuous form paper which may be single or multi-ply is the preferred recording medium used in printers associated with computers and word processors. In normal operation, one form passing through a printer pulls the next form from a stack of blank forms into the printer. The forms exiting from the printer fold themselves back into a stack usually aided only by gravity.

For low speed printers such an arrangement is usually sufficient, however, even for low speed printers under certain environmental conditions, for example, very low relative humidity, a static charge may build up on the paper and cause the paper to jam in the exit chute of the printer. Jamming of the paper may often result in printer downtime, and possibly in a loss of information.

DISCLOSURE OF THE INVENTION

In accordance with the present invention we provide an apparatus for handling the continuous form paper exiting from a printer. The apparatus includes two drive rollers mounted on a driven shaft by a pair of spring loaded split hubs. The drive rollers support the paper and each drive roller has a pressure finger associated with it to hold the paper against a roller. The rollers, aided by the pressure fingers, apply a tensile force to the back surface of the paper for pulling the paper from the printer. The pressure fingers are periodically lifted from the paper to permit straight paper flow and to relieve shifting between piles of a multi-ply paper.

THE DRAWING

FIG. 1 is a perspective view of a printer and the associated continuous form paper handling apparatus in accordance with the present invention.

FIG. 4 is a cross-sectional view of the drive roller, taken along line 4—4 of FIG. 2.

DETAILED DESCRIPTION

Figure 2:
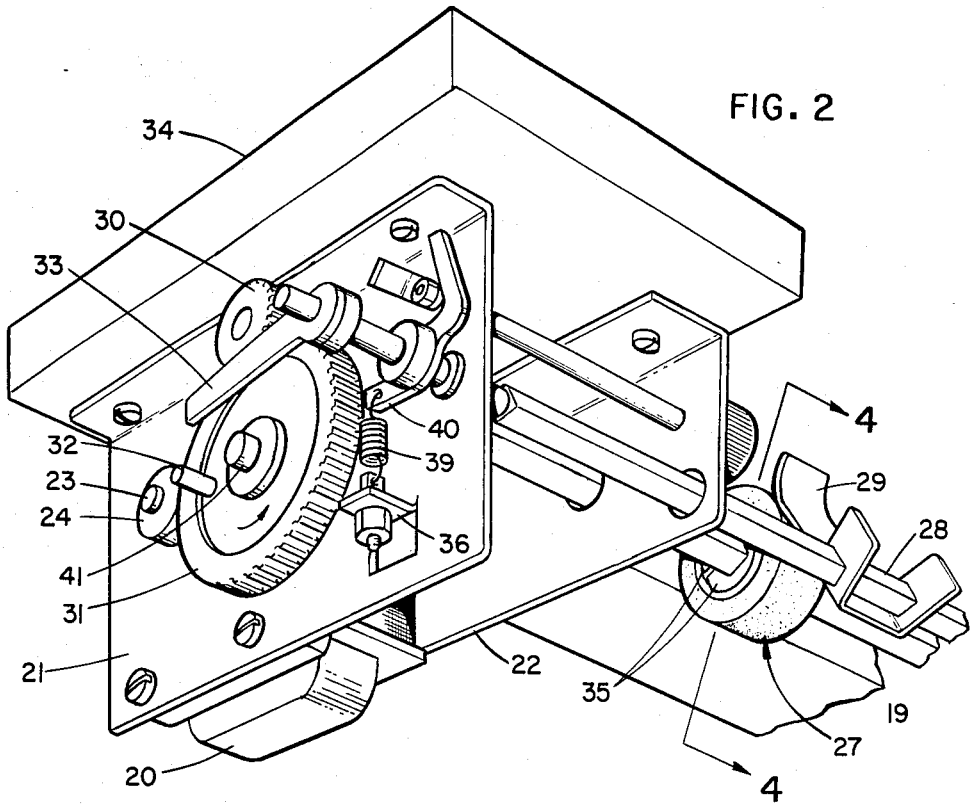
FIG. 2 is a perspective detailed view of the driving mechanism of the paper handling apparatus.
Figure 3:
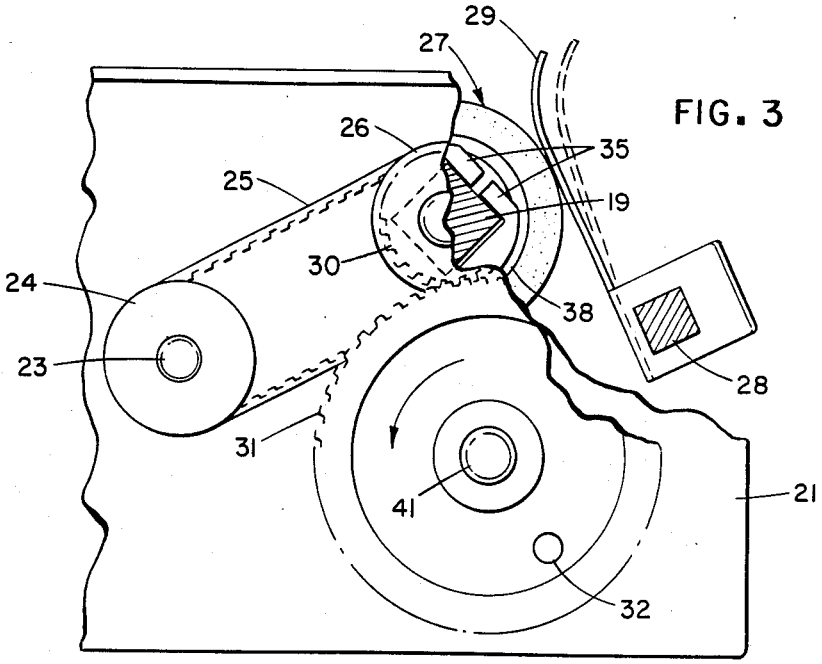
FIG. 3 is a partial left plan view of the mechanism shown in FIG. 2.

In FIG. 1 there is shown a printer 10 having a web of continuous form paper 12 exiting from a printer exit chute 11. A paper handling apparatus 13 is positioned near the printer 10 and is arranged to pull the web of continuous form paper 12 exiting from the printer 10 and stack the paper 12 in an adjustable tray 14.

The paper handling apparatus 13 has a substantially "U" shaped frame assembly which is formed by vertical hollow side sections 16 and 17, a back section 18 and a top section 34. The top section 34, as shown in FIG. 2, has brackets 21 and 22 mounted on its bottom side and positioned so that the brackets 21 and 22 extend downward into the hollow section of the vertical section 16 when the top section 34 is in its proper place in the assembled paper handling apparatus 10.

A shaft 19 extends between the two vertical sections 16 and 17 and is rotatably supported by the bracket 21 and a bracket (not shown) extending downward from top section 34 into the hollow portion of the vertical side section 17. A pair of drive rollers 27 (only one is shown in FIG. 2) are mounted on the shaft 19 via spring loaded split hubs 35 one of which is shown associated with the drive roller 27 shown in FIG. 2. The spring loaded hubs 35 allow relative motion between the shaft 19 and each drive roller 27.

A detailed illustration of a spring loaded hub 35 and its application in the mounting of a drive roller 27 is shown in the cross-sectional view of a drive roller 27 in FIG. 4. The drive roller 27 has a hollow cylindrical stainless steel core 38 surrounded by a layer of urethane foam material such as for example Rogers Endur-C (TM) 300. The hub 35, comprised of two substantially identical halves made of a teflon filled acetal material, is located inside the hollow portion of the core 38. The two halves of the hub 35 slidably encompass the shaft 19 and are pressed against the ID surface of the hollow portion of the core 38 by a pair of springs 39.

A shaft 28 is also rotatably mounted between the vertical sections 16 and 17 and is located a predetermined distance away and parallel to the shaft 19. A pair of pressure fingers 29 made of a resilient material are slidably mounted on the shaft 28 and each finger 29 is positioned opposite a drive roller 27. The pressure fingers 29 are held against the respective drive rollers 27 by an extension spring 39 having one end fastened to an adjustable mounting 36 and the other end to an arm 40 on the shaft 28. The spring 39 exerts a rotational force in a counterclockwise direction which is transmitted to the pressure fingers 29 via the shaft 28.

A shaded pole gear motor 20 is mounted on bracket 21. The motor 20 has an output shaft 23 for mounting thereon a motor output pulley 24. A drive roller pulley 26 is mounted on the shaft 19 and is driven by the gear motor 20 via a belt 25 which passes around the motor output pulley 24 and the drive shaft pulley 26. A gear 30 is mounted on the drive shaft 19 and mates with lifter gear 31 which is rotatably mounted on a shaft 41 extending from the bracket 21. The lifter gear 31 has extending from one of its surfaces, a cylindrical post 32 having its major axis substantially parallel to the axis of the rotation of the two gears 30 and 31.

Rotation of the lifter gear 31 first moves the post into contact with an arm 33 mounted on the shaft 28 and then displaces the arm 33 a predetermined distance. Displacement of the arm 33 in turn rotates the shaft 28 in a clockwise direction moving the pressure fingers 29 away from the drive rollers 27. The angle of the arm 33 relative to the pressure fingers 29, the gear ratio between the two gears 30 and 31, the spring deflection rate of the pressure fingers 29, and the speed of rotation of the gear 30 determine the amount of time that the pressure fingers 29 are out of contact with the paper 12 supported by the drive rollers 27.

When the paper handling apparatus 13 is turned on, the motor 20 runs continuously near its nominal RPM. The continuous form paper 12 after exiting from the exit chute 11 is fed between the drive rollers 27 and the pressure fingers 29. The pressure fingers 29 press the paper 12 against the drive rollers 27 which exert a tensile force on the paper 12 pulling it from the exit chute 11.

As was previously pointed out, the drive rollers 27 are mounted on the drive shaft 19 via spring loaded split hubs 35 permitting relative motion between the rollers 27 and the shaft 19. This results in a substantially constant tension applied to the paper 12 by the drive rollers 27 as long as speed of the paper 12 exiting the printer 10 doesn't exceed surface speed of drive rollers 27.

Lifting of the pressure fingers 29 from the paper 12 for a short period of time helps maintain straight flow of paper 12, and if the continuous form paper 12 is comprised of multiple plies, minor shifting of the various plies relative to one another will also be relieved.

What is claimed is:

1. Apparatus for handling fanfold paper exiting from a printing device, the apparatus comprising:

a support frame;

a first shaft rotatably mounted in the support frame;

a drive roller mounted on the first shaft for supporting the back surface of the paper;

means for continuously driving the first shaft at a substantially constant predetermined rotational speed;

a second shaft rotatably mounted in the support frame, located a predetermined distance away and parallel to the first shaft;

a pressure finger mounted on the second shaft, positioned opposite the drive roller;

means for applying a rotational force to the second shaft for biasing the pressure finger towards the drive roller whereby the pressure finger holds the paper against the drive roller; and means driven by the first shaft for periodically lifting the pressure finger away from the drive roller for a predetermined period of time.

2. Apparatus in accordance with claim 1, wherein the drive roller is mounted on the first shaft via a spring loaded split hub.

3. Apparatus in accordance with claim 1, wherein the rotational speed of the first shaft is such that the surface speed of the drive roller mounted on it is equal to or greater than the speed of the paper exiting from the printer.

4. Apparatus in accordance with claim 1, wherein the means for periodically lifting the pressure finger includes a rotatably mounted lifter gear, a post extending from one of the surfaces of the gear in a direction substantially parallel to the axis of rotation of the gear, and a lifter arm mounted on the second shaft and arranged to be contacted by the post.

5. Apparatus for handling fanfold paper exiting from a printing device, the apparatus comprising:

a support frame;

a first shaft rotatably mounted in the support frame;

a drive roller having a spring loaded split hub mounted on the first shaft for supporting the back surface of the paper;

means for driving the first shaft at a substantially constant speed such that the surface speed of the drive roller mounted on the shaft is equal to or greater than the speed of the paper exiting from the printer;

a second shaft rotatably mounted in the support frame, located a predetermined distance away and parallel to the first shaft;

a pressure finger mounted on the second shaft, positioned opposite the drive roller;

means for applying a rotational force to the second shaft for biasing the pressure finger towards the drive roller whereby the pressure finger holds the paper against the drive roller; and means driven by the rotating first shaft for periodically lifting the pressure finger away from the drive roller including a rotatably mounted lifter gear, a post extending from one of the surfaces of the gear in a direction substantially parallel to the axis of rotation of the gear, and a lifter arm mounted on the second shaft and arranged to be contacted by the post.

* * * * *